US008978949B2

(12) United States Patent
Arajakis

(10) Patent No.: US 8,978,949 B2
(45) Date of Patent: Mar. 17, 2015

(54) CROSSBOW CASE

(71) Applicant: GamePlan Gear LLC, Dubuque, IA (US)

(72) Inventor: Michael M. Arajakis, Boardman, OH (US)

(73) Assignee: GamePlan Gear LLC, Dubuque, IA (US)

( * ) Notice: Subject to any disclaimer, the term of this patent is extended or adjusted under 35 U.S.C. 154(b) by 0 days.

(21) Appl. No.: 13/857,915

(22) Filed: Apr. 5, 2013

(65) Prior Publication Data

US 2013/0264233 A1 Oct. 10, 2013

Related U.S. Application Data

(60) Provisional application No. 61/620,437, filed on Apr. 5, 2012.

(51) Int. Cl.
*A45F 3/04* (2006.01)
*F41B 5/14* (2006.01)

(52) U.S. Cl.
CPC *F41B 5/1457* (2013.01); *A45F 3/04* (2013.01)
USPC ..... 224/657; 224/153; 224/642; 224/644; 224/650

(58) Field of Classification Search
USPC ..... 224/657, 153, 642, 644, 650
See application file for complete search history.

(56) References Cited

U.S. PATENT DOCUMENTS

| | | | | | |
|---|---|---|---|---|---|
| D182,868 | S * | 5/1958 | Arnold | D3/289 |
| 4,236,657 | A * | 12/1980 | Brunton | 224/153 |
| 4,480,774 | A * | 11/1984 | Smith et al. | 224/610 |
| 5,361,955 | A * | 11/1994 | Gregory | 224/630 |
| 5,826,746 | A * | 10/1998 | Ash, Jr. | 221/185 |
| 5,984,154 | A * | 11/1999 | Scicluna | 224/153 |
| 5,988,465 | A * | 11/1999 | Vitale et al. | 224/155 |
| 6,290,114 | B1 * | 9/2001 | Berberian | 224/642 |
| 6,505,762 | B2 * | 1/2003 | Wilfer | 224/153 |
| 6,536,638 | B1 * | 3/2003 | Gulmatico, III | 224/153 |
| 6,592,012 | B2 * | 7/2003 | Godshaw et al. | 224/153 |
| 6,598,772 | B1 * | 7/2003 | Wilfer | 224/629 |
| 6,691,693 | B1 * | 2/2004 | Trussell, II | 124/25.6 |
| 6,742,684 | B2 * | 6/2004 | Oh | 224/153 |
| 6,763,987 | B1 * | 7/2004 | Eberle | 224/637 |
| 6,935,495 | B1 * | 8/2005 | McKenzie | 206/315.11 |
| 7,575,138 | B2 * | 8/2009 | Lindberg | 224/645 |
| 7,654,426 | B2 * | 2/2010 | Eberle | 224/637 |
| 8,047,413 | B2 * | 11/2011 | Arajakis | 224/577 |
| 8,292,136 | B2 * | 10/2012 | Tonelli | 224/250 |
| 2001/0015365 | A1 * | 8/2001 | Flynn | 224/259 |
| 2005/0056669 | A1 * | 3/2005 | Lavelle | 224/153 |
| 2007/0145089 | A1 * | 6/2007 | Robert | 224/637 |
| 2009/0249527 | A1 * | 10/2009 | Hunte | 2/84 |

* cited by examiner

*Primary Examiner* — Justin Larson
*Assistant Examiner* — Lester L Vanterpool
(74) *Attorney, Agent, or Firm* — Rathe Lindenbaum LLP

(57) ABSTRACT

A crossbow case comprises a T-shaped body forming a T-shaped internal cavity to receive a crossbow and a pair of shoulder straps attached to and extending from an upper horizontal portion of the body. Each of the straps has an end releasably connected to a lower vertical portion of the body.

25 Claims, 5 Drawing Sheets

CROSSBOW CASE

CROSS-REFERENCE TO RELATED PATENT APPLICATIONS

The present application is a continuation application claiming priority under 35 USC Section 120 from U.S. Provisional Application Ser. No. 61/620,437 filed on Apr. 5, 2012 by Michael M. Arajakis and entitled CROSSBOW CASE, full disclosure of which is hereby incorporated by reference.

BACKGROUND

Crossbows are frequently used to hunt. To carry the crossbows across large distances, slings are sometimes attached to the crossbow itself. During such transport, the crossbow is exposed to the elements and is also vulnerable to becoming snagged on brush and other plant or wooded growth.

BRIEF DESCRIPTION OF THE DRAWINGS

FIG. 1 illustrating deployment of shoulder straps.

DETAILED DESCRIPTION OF THE EXAMPLE IMPLEMENTATIONS

Figure 1:
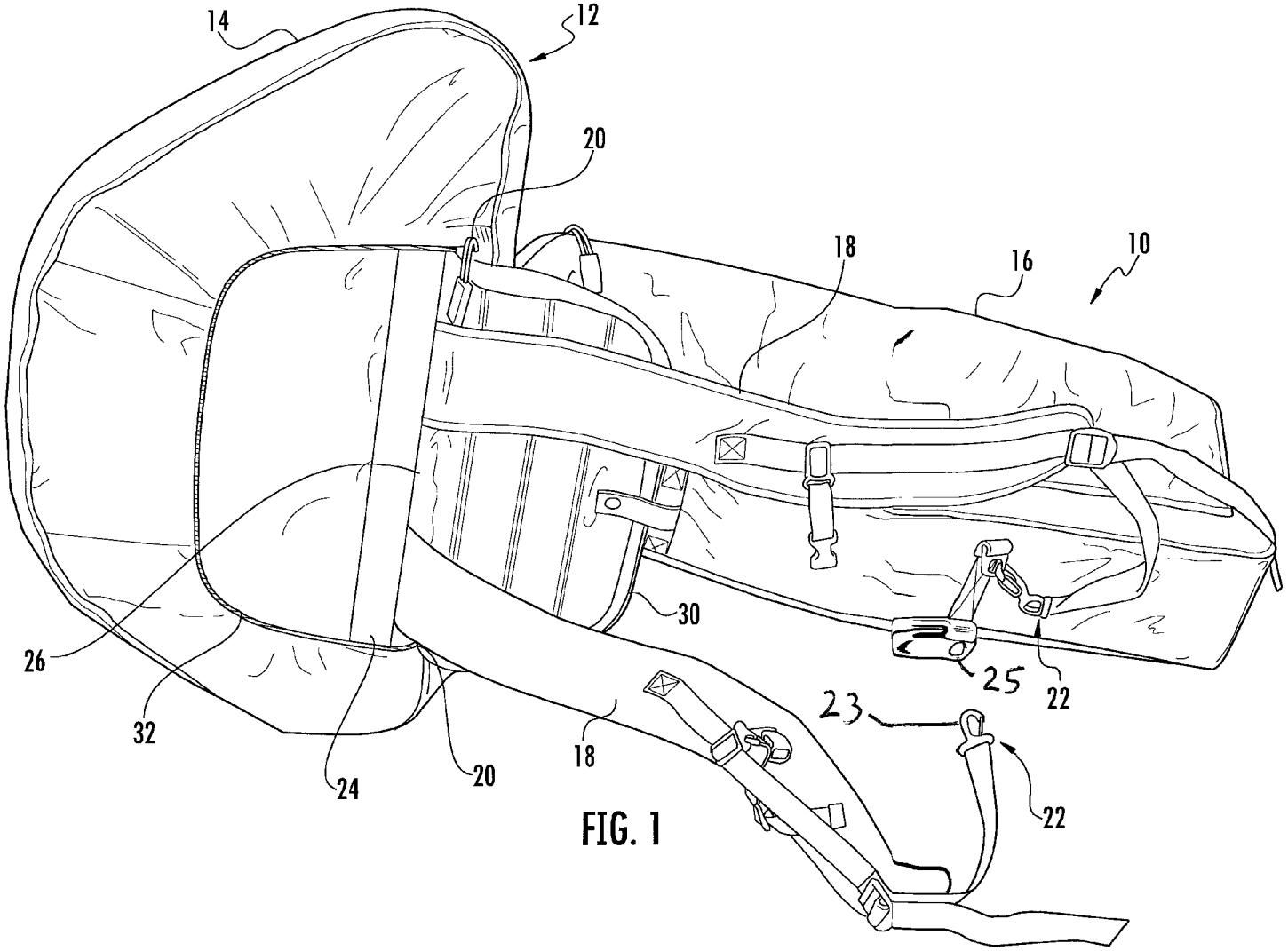
FIG. 1 is a rear perspective view of an example crossbow case for transporting a crossbow.

FIG. 1 illustrates a crossbow case 10 having a T-shaped body 12 with an upper horizontal portion 14 and a lower vertical portion 16. Body 12 forms a T-shaped internal body to receive a crossbow. Crossbow case 10 comprises a pair of shoulder straps 18 having a first end 20 attached or connected to body 12 and a second opposite end 22 attachable to lower vertical portion 16 of body 12. In the example illustrated, end 22 include one of hooks 23 and rings 25 while the lower vertical portion 16 include the other of hooks 23 and rings 25 facilitating such releasable attachment. In other implementations, other mechanisms, such as snap clips may be used to facilitate such releasable attachment.

Figure 2:
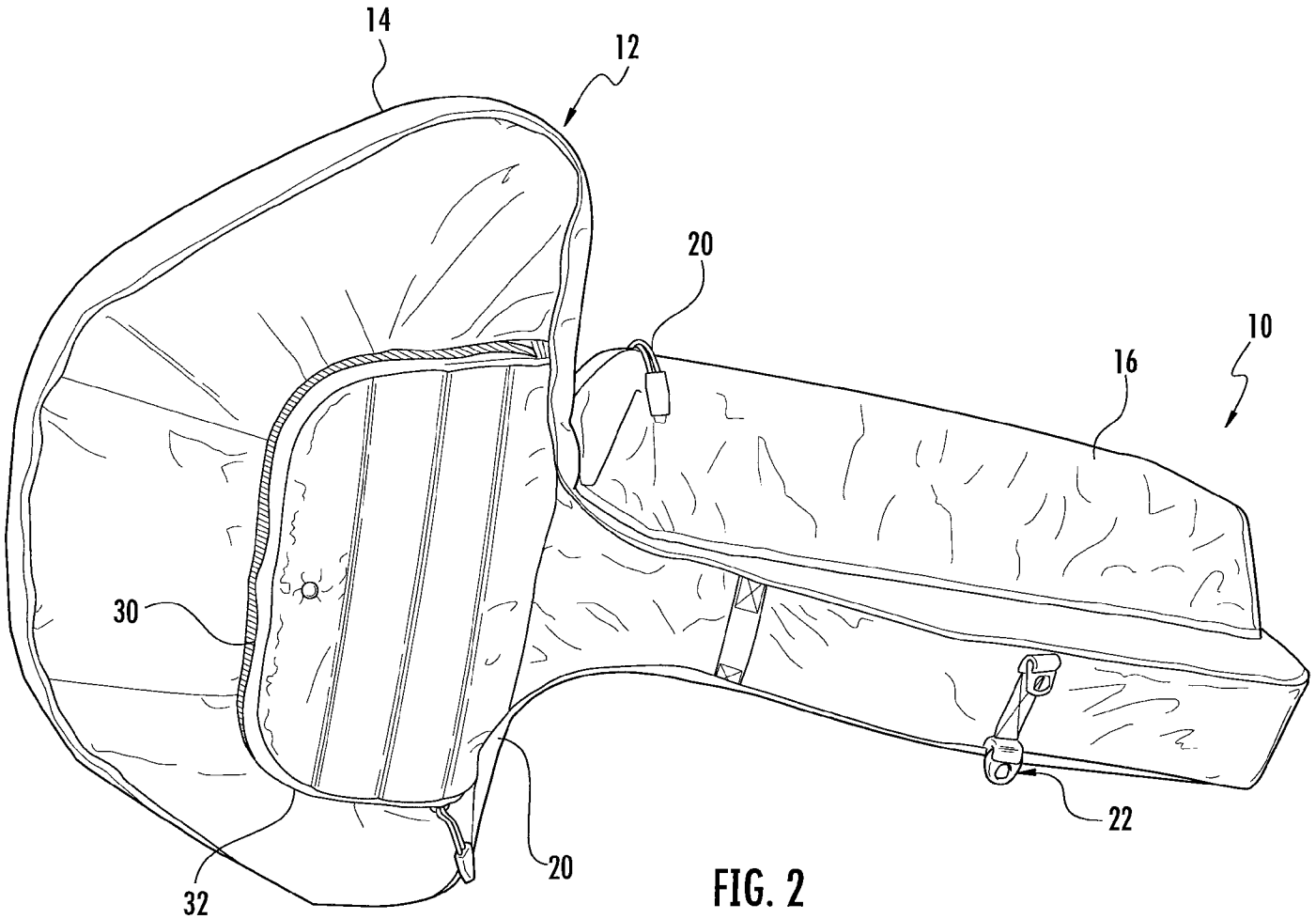
FIG. 2 is a rear perspective view of the crossbow case of FIG. 1; You 2 illustrating retraction and storage of the shoulder straps in the crossbow case.

As shown by FIG. 2, shoulder straps 18 may be disconnected from lower vertical portion 16 and folded or collapsed into pocket 24 (shown in FIG. 1) having a downwardly facing opening 26. Because pocket 24 faces in a downward direction, pocket 24 is less likely to fill with rain or snow. In the example illustrated, an entirety of shoulder straps 18 is receivable within the stowaway pouch or pocket 24.

As shown in FIG. 2, the opening of pocket 24 is closable by means of a flap 30 which may be zipped and a closed state by a zipper 32 so as to close opening 26 and overlap pocket 24. Flap 30 hangs below the opening of pocket 24 of straps 18 are deployed and extends across and above the opening 26 of pocket 24 when straps 18 are stored within pocket 24. In the example illustrated, flap 30 is zipped close by zipper extending around an exterior base and floor of pocket 24, rather than along or across mouth or opening 26. Because an upper edge of panel or flap 30 is zipped or otherwise secured to case 10 above mouth or opening 26 of pocket 24, flap 30 may be unzipped otherwise uncoupled to open pocket 24 from a top end of case 10. Moreover, less pressure is imposed upon zipper 32 in circumstances where straps 18 are not compactly inserted into pocket 24.

In other implementations, flap 30 may be releasably connected to case 10 by hook and loop fastening arrangement, a snap clip or other fastening mechanisms instead of the illustrated zipper 32. In other implementations, flap 30 may be secured to pocket 24 along the mouth of pocket 24 resident above the mouth of pocket 24. In yet other implementations, flap 30 may be omitted, wherein the mouth of pocket 24 is closable with a zipper, hook and loop fastener arrangement, clip or other mechanism.

As shown by FIG. 2, the base ends of each of shoulder straps 18 are coupled to or connected to a remainder of case 10 at locations within pocket 24, wherein straps 18 simply extend downward out-of-pocket 24 when flap 30 is lowered. In one implementation, the base ends of each of shoulder shaft 18 are pivotably coupled to or connected to a remainder of case 10 at locations within pocket 24. In the example illustrated, flap 30 is padded so as to pad rigid portions of shoulder straps 18 within pocket 24. As shown by FIG. 1, flap 30 may be unzipped and opened, allowing shoulder straps 18 to be deployed, wherein the padded flap 30 extends between shoulder straps 18 and body 12 provided additional padding or cushioning for a person wearing the shoulder straps 18 during transport of a crossbow.

Figure 3:
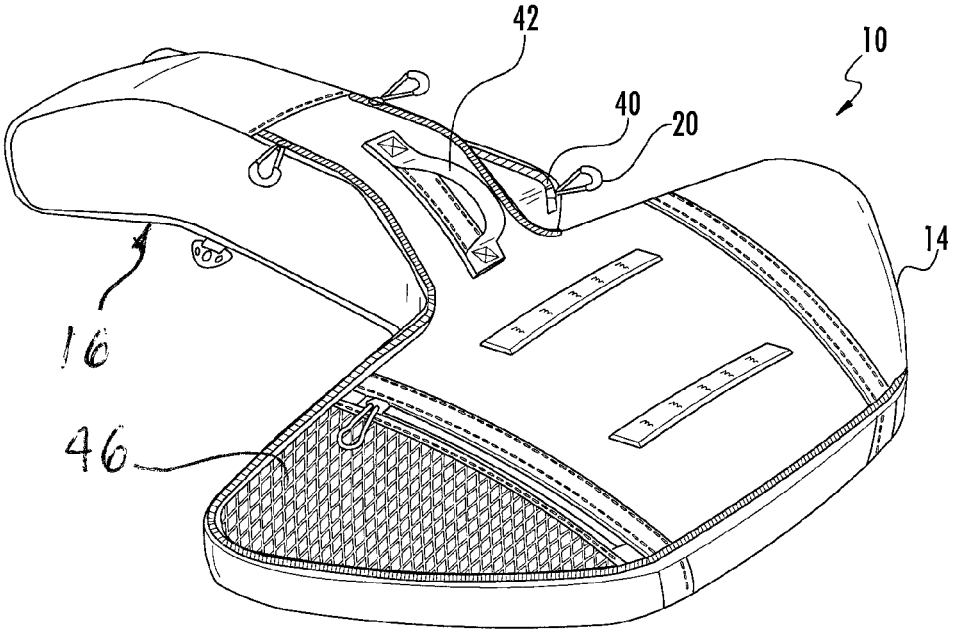
FIG. 3 is a rear view of the crossbow case of FIG. 1 with the shoulder straps being deployed.
Figure 4:
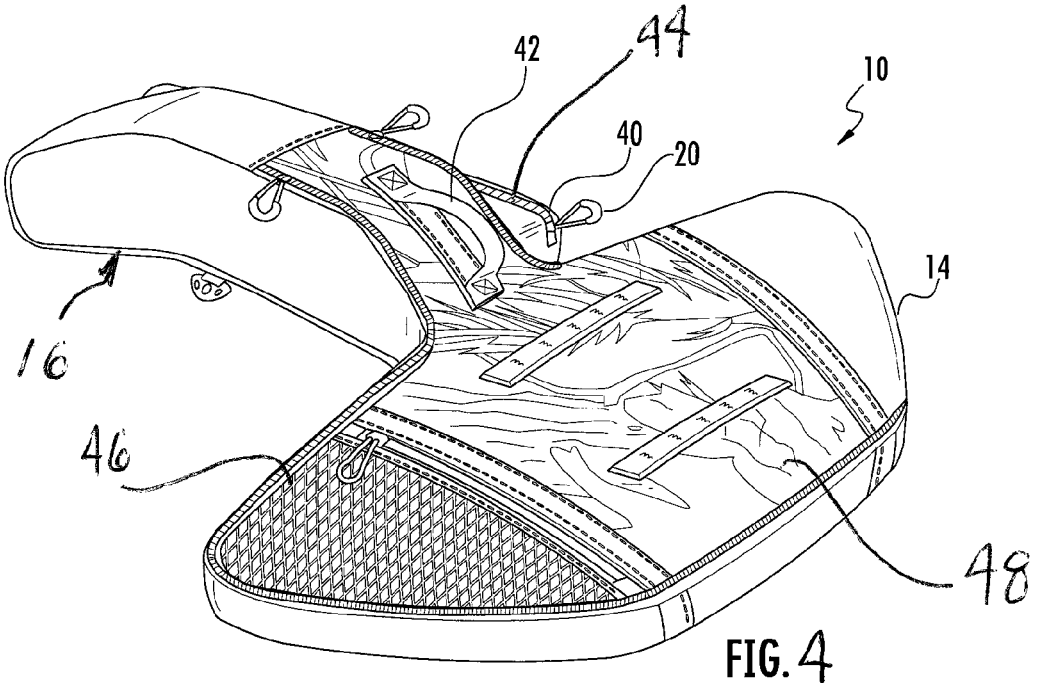
FIG. 4 is a front perspective view of the crossbow case of FIG. 1.

FIGS. 3 and 4 illustrate an opposite side of case 10. As shown by FIGS. 3 and 4, crossbow case 10 additionally includes an auxiliary support box or pocket 40 and a strap serving as a handle 42. Pocket 40 is openable and closable by means of a zipper 44 and is sized or configured to contain arrows. Pocket 44 extends alongside the lower vertical portion 16 of case 10. In one implementation, the backside of lower vertical portion 16 is padded with a foam back panel, further providing for comfort when case 10 is being worn by a person. In the example illustrated, The front face of case 10 further includes a zippered mesh accessory pocket 46. In the example shown in FIG. 5, the front face of case 10 further comprising camouflaged region 48. In other implementations such additional features may be omitted.

Figure 5:
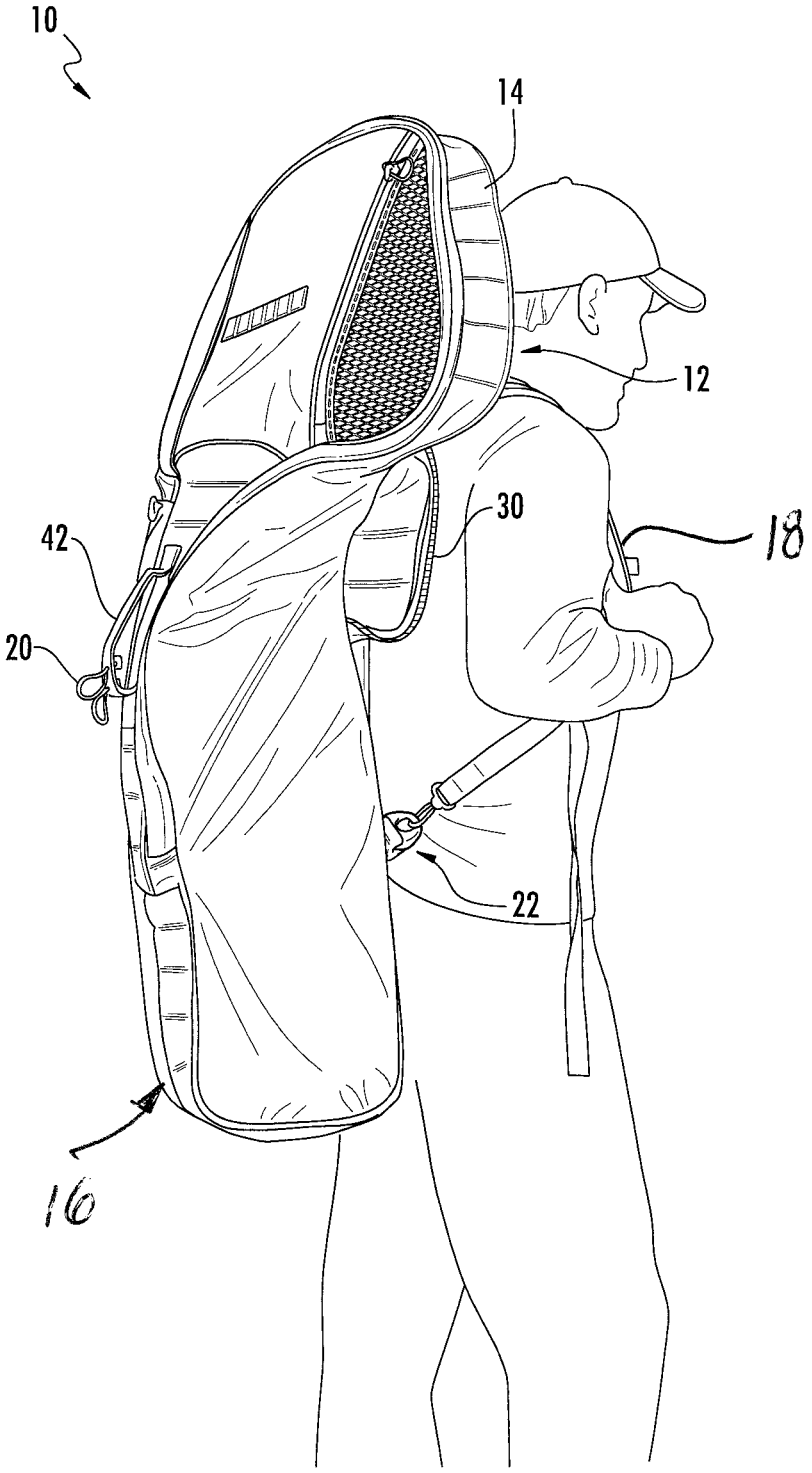
FIG. 5 is a front perspective view of another example of the crossbow case of FIG. 1.

FIG. 5 illustrates case 10, containing a crossbow (not shown), being warned by a person for transport of the contained crossbow. As shown by FIG. 5, when case 10 is worn, flap 30 is lowered, opening the lower mouth of pocket 24 and allowing straps 18 to be deployed over and about the person shoulders. The lower ends 22 of straps 18 are hooked (or otherwise releasably connected) to vertical portion 16. Because vertical portion 16 is padded and because flap 30 is also padded, having one or more layers or panels of foam or other compressible material, case 10 is comfortable to wear over long distances. Straps 18 distribute the load of the carried crossbow across the person shoulders. During such transport, the crossbow within case 10 is completely enclosed and is protected from the elements (rain, snow). In addition, crossbow 10 is less likely to snag upon underbrush, plant growth or other obstructions that may be encountered during transport through a wilderness or wooded area.

Figure 6:
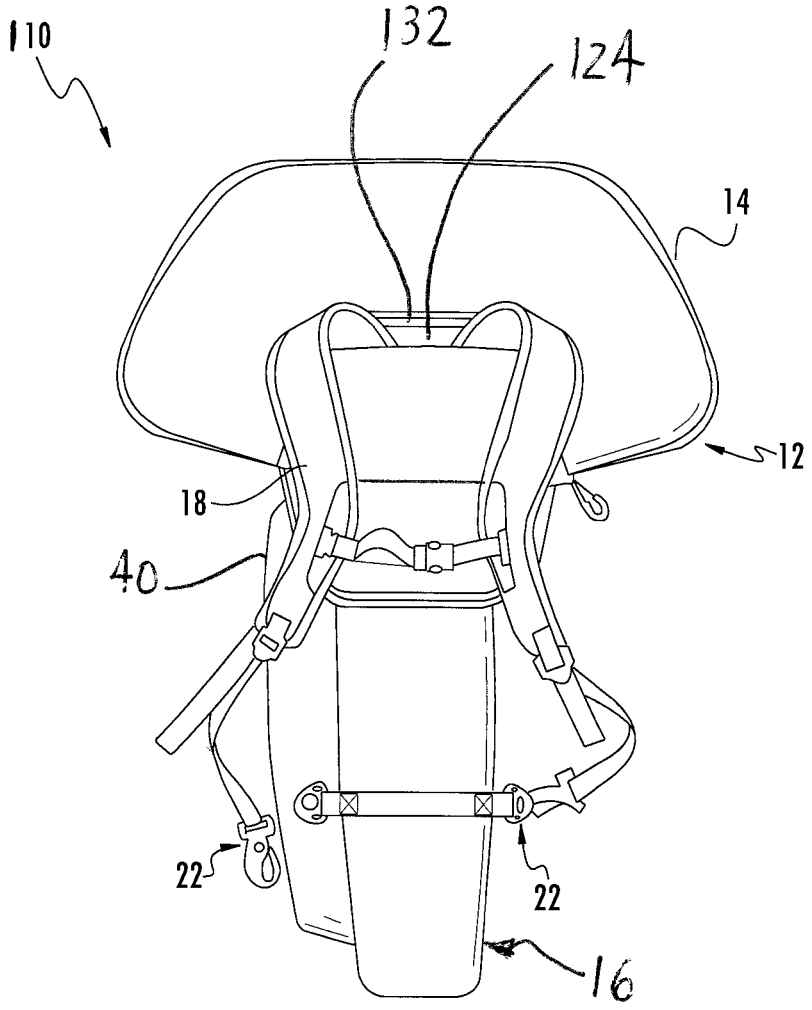
FIG. 6 is a rear perspective view of the crossbow case of FIG. 1 containing a crossbow and being worn by a person

FIG. 6 illustrates case 110, another example implementation of case 10. Case 110 is similar to case 10 except that case 110 comprises an upwardly facing pocket 124, from the interior of which straps 18 extend. Those remaining components of case 110 which correspond to components of case 10 are numbered similarly. In the example illustrated, pocket 124 includes a zippered mouth 132. In another implementation, the upwardly facing pocket 124 may alternatively be covered and/or closed by an overlapping flap similar to flap 30.

Although the present disclosure has been described with reference to example embodiments, workers skilled in the art will recognize that changes may be made in form and detail without departing from the spirit and scope of the defined subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a crossbow case comprising:

a T-shaped body forming a T-shaped internal cavity to receive a crossbow;

a pair of shoulder straps attached to and extending from an upper horizontal portion of the body, each of the straps having an end releasably connected to a lower vertical portion of the body, each of straps having an upper padded portion directly connected to the upper horizontal portion of the T-shaped body and a lower unpadded portion.

2. The apparatus of claim 1 further comprising a pocket to receive the shoulder straps while the shoulder straps remain attached to the T-shaped body, wherein the pocket comprises a panel joined to an exterior of the T-shaped body to form an interior between the panel and the T-shaped body, the interior having a vertically facing mouth.

3. The apparatus of claim 2, wherein the shoulder straps are attached to the T-shaped body within the pocket.

4. The apparatus of claim 3, further comprising a zipper to close the pocket.

5. The apparatus of claim 4 further comprising a flap pivotable about a horizontal axis, an end of the flap being releasably connected to the T-shaped body at a location above the mouth by the zipper closing the pocket.

6. The apparatus of claim 5, wherein the flap is padded and overlaps the pocket in the position closing the pocket.

7. The apparatus of claim 6, wherein the mouth faces in a downward direction when the upper padded portion of the pair shoulder straps extend about a person shoulders and wherein the flap extends between the shoulder straps and the body when the pocket is opened and the end of each of the shoulder straps is releasably connected to the lower vertical portion of the body.

8. The apparatus of claim 2 further comprising a flap pivotable about a horizontal axis, an end of the flap being releasably connected to the T-shaped body at a location above the mouth closing the pocket.

9. The apparatus of claim 8, wherein the flap is padded and overlaps the pocket in the position closing the pocket.

10. The apparatus of claim 9, wherein the flap extends between the shoulder straps and the body when the pocket is opened and the end of each of the shoulder straps is releasably connected to the lower vertical portion of the body.

11. The apparatus of claim 2, wherein the shoulder straps are completely receivable within the pocket when the pocket is in a closed state.

12. The apparatus of claim 2, wherein each of the shoulder straps has a second end within the pocket.

13. The apparatus of claim 12, wherein the pocket faces downwardly from the upper horizontal portion of the body towards the lower vertical portion of the body.

14. The apparatus of claim 2, wherein the pocket faces downwardly from the upper horizontal portion of the body towards the lower vertical portion of the body.

15. The apparatus of claim 2, wherein the pocket faces upwardly away from the lower vertical portion of the body.

16. The apparatus of claim 1, wherein the lower vertical portion of the body comprises padding.

17. The apparatus of claim 1 further comprising:

rings attached to one of the lower vertical portion of the body and the end of each of the shoulder straps; and hooks attached to the other of the lower vertical portion of the body and the end of each of the shoulder straps.

18. The apparatus of claim 1, wherein the T-shaped internal cavity is configured to completely enclose an entirety of the crossbow.

19. The apparatus of claim 2, wherein the pocket is formed along the upper horizontal portion of the T-shaped body.

20. The apparatus of claim 8, wherein the flap is pivotable about a horizontal axis and hangs from below the pocket when the crossbow case is being worn using the pair of shoulder straps.

21. The apparatus of claim 1, wherein the shoulder straps are located to support the upper horizontal portion of the body above shoulders of a portion when the crossbow case is worn using the shoulder straps.

22. An apparatus comprising:

a crossbow case comprising:

an upright T-shaped body forming a T-shaped internal cavity to receive a crossbow;

a pair of shoulder straps attached to and extending from an upper horizontal portion of the body, each of the straps having an end releasably connected to a lower vertical portion of the body;

a pocket to receive the shoulder straps while the shoulder straps remain attached to the T-shaped body, wherein the shoulder straps are attached to the T-shaped body within the pocket, the pocket having a downwardly facing mouth;

a zipper to close the pocket; and a flap held by the zipper in a position closing the pocket, wherein the flap is padded and overlaps the pocket in the position closing the pocket and wherein the flap extends between the shoulder straps and the body when the pocket is opened and the end of each of the shoulder straps is releasably connected to the lower vertical portion of the body.

23. An apparatus comprising:

a crossbow case comprising:

an upright T-shaped body forming a T-shaped internal cavity to receive a crossbow;

a pair of shoulder straps attached to and extending from an upper horizontal portion of the body, each of the straps having an end releasably connected to a lower vertical portion of the body;

a pocket to receive the shoulder straps while the shoulder straps remain attached to the T-shaped body, the pocket having a downwardly facing mouth;

a flap held in a position closing the pocket, wherein the flap is padded and overlaps the pocket in the position closing the pocket and wherein the flap extends between the shoulder straps and the body when the pocket is opened and the end of each of the shoulder straps is releasably connected to the lower vertical portion of the body.

24. An apparatus comprising:

a crossbow case comprising:

an upright T-shaped body forming a T-shaped internal cavity to receive a crossbow;

a pair of shoulder straps attached to and extending from an upper horizontal portion of the body, each of the straps having an end releasably connected to a lower vertical portion of the body;

a pocket to receive the shoulder straps while the shoulder straps remain attached to the T-shaped body, wherein the pocket faces downwardly from the upper horizontal portion of the body towards the lower vertical portion of the body.

25. An apparatus comprising:

a crossbow case comprising:

an upright T-shaped body forming a T-shaped internal cavity to receive a crossbow;

a pair of shoulder straps attached to and extending from an upper horizontal portion of the body, each of the straps having an end releasably connected to a lower vertical portion of the body;

a pocket to receive the shoulder straps while the shoulder straps remain attached to the T-shaped body, wherein the pocket receives upper ends of the shoulder straps.

* * * * *